US010829700B2

(12) United States Patent
Charra et al.

(10) Patent No.: US 10,829,700 B2
(45) Date of Patent: Nov. 10, 2020

(54) METHOD FOR THE SELECTIVE HYDROGENATION OF A PYROLYSIS GASOLINE FEEDSTOCK WITH A THREE-PHASE REACTOR

(71) Applicant: IFP ENERGIES NOUVELLES, Rueil-Malmaison (FR)

(72) Inventors: Cyprien Charra, Lyons (FR); Vincent Coupard, Villeurbanne (FR); Jeremy Gazarian, Lyons (FR); Adrien Mekki-Berrada, St Etienne (FR); Jean-Marc Schweitzer, Villette de Vienne (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 16/320,816

(22) PCT Filed: Jun. 22, 2017

(86) PCT No.: PCT/EP2017/065382
§ 371 (c)(1),
(2) Date: Jan. 25, 2019

(87) PCT Pub. No.: WO2018/019490
PCT Pub. Date: Feb. 1, 2018

(65) Prior Publication Data

US 2019/0153338 A1 May 23, 2019

(30) Foreign Application Priority Data

Jul. 27, 2016 (FR) ..... 16 57213

(51) Int. Cl.
*C10G 45/00* (2006.01)
*C10G 45/42* (2006.01)
(Continued)

(52) U.S. Cl.
CPC ..... *C10G 45/42* (2013.01); *C10G 45/02* (2013.01); *C10G 65/06* (2013.01);
(Continued)

(58) Field of Classification Search
CPC ..... C10G 45/02; C10G 45/32; C10G 45/34; C10G 45/36; C10G 45/38; C10G 45/40;
(Continued)

(56) References Cited

U.S. PATENT DOCUMENTS 6,278,034 B1 * 8/2001 Espinoza ..... B01J 8/226 585/275
7,453,016 B1 * 11/2008 Gajda ..... B01J 23/58 585/259
(Continued)

FOREIGN PATENT DOCUMENTS

CN 103044179 A 4/2013
CN 103805253 A 5/2014
WO WO-2010144512 A2 * 12/2010 ..... C10G 45/02

OTHER PUBLICATIONS

International Search Report PCT/EP2017/065382 dated Jul. 28, 2017 (pp. 1-4).

*Primary Examiner* — Prem C Singh
*Assistant Examiner* — Brandi M Doyle
(74) *Attorney, Agent, or Firm* — Millen White Zelano and Branigan, PC; John Sopp

(57) ABSTRACT

This invention has as its object a method for selective hydrogenation of a feedstock comprising a pyrolysis gasoline carried out in a three-phase reactor.

14 Claims, 2 Drawing Sheets

(51) Int. Cl.
*C10G 45/02* (2006.01)
*C10G 65/06* (2006.01)

(52) U.S. Cl.
CPC ... *C10G 2300/202* (2013.01); *C10G 2400/02* (2013.01); *C10G 2400/30* (2013.01)

(58) Field of Classification Search
CPC .... C10G 45/42; C10G 65/06; C10G 2400/02; C10G 2400/30; C10G 2300/202
See application file for complete search history.

(56) References Cited

U.S. PATENT DOCUMENTS

| | | | | |
|---|---|---|---|---|
| 2006/0086645 | A1* | 4/2006 | Rock | C10G 45/00 208/218 |
| 2013/0204055 | A1* | 8/2013 | Davis | C07C 5/09 585/254 |
| 2013/0211163 | A1 | 8/2013 | Diehl et al. | |

* cited by examiner

METHOD FOR THE SELECTIVE HYDROGENATION OF A PYROLYSIS GASOLINE FEEDSTOCK WITH A THREE-PHASE REACTOR

This invention has as its object a method for selective hydrogenation of a feedstock comprising a pyrolysis gasoline that is carried out in a three-phase reactor, often also called "slurry" reactor according to English terminology.

Various pyrolysis methods, such as steam-cracking, visbreaking or coking, lead to the formation of gasolines, also called pyrolysis gasolines or "pygas" according to English terminology, which do not meet specifications. Actually, they contain—in variable proportions—unsaturated, unstable and oxidizable hydrocarbons, such as alkadienes or alkenylaromatic compounds; these different compounds have a tendency to polymerize, providing gums that are unacceptable for subsequent use. In addition to the possibility of greatly diluting these gasolines in more compliant fuel bases, there is the solution of eliminating these unsaturations by hydrogenation.

There are currently two paths for upgrading these gasolines: the first as fuel with a high octane number, the second as a source for a fraction that is rich in aromatic hydrocarbons.

In the first case, it is necessary to eliminate selectively the unstable gum-generating compounds, without thereby decreasing the octane number thereof. Currently, the method that is considered to be the most economical is the selective hydrogenation of diolefinic components and alkenylaromatic components into monoolefins and corresponding alkylaromatic compounds without thereby hydrogenating the monoolefins and aromatic nuclei. Gasoline that is obtained from selective hydrogenation is then generally preferably subjected to a hydrodesulfurization step.

In the second case, where these gasolines are intended for the extraction of aromatic compounds, the treatment is more complex: it is necessary not only to eliminate the highly unsaturated compounds but also the olefins and the sulfide compounds. The hydrodesulfurization of these fractions as well as the almost complete hydrogenation of the olefins that they contain are performed in the vapor phase and require temperatures that are too high for it to be possible to produce them without polymerizing the most unstable compounds and producing gums. This operation can be carried out only if care has been taken to eliminate the highly unsaturated compounds during a first step for selective hydrogenation that is carried out in the liquid phase, at low temperature.

The hydrogenation of the pyrolysis gasoline is then done conventionally in two steps: a first step, also called HD1, aiming at the selective hydrogenation that takes place in a fixed-bed reactor in the liquid phase, and a second step, also called HD2, aiming in particular at the hydrodesulfurization that takes place in another fixed-bed reactor in the gaseous phase. It is common practice to initiate separations between the two steps, for example by recovering a top fraction (C5−) for the gasoline pool and/or re-cracking, or else by extracting a bottom fraction (C9+) for reducing the feedstock flow rate of the hydrodesulfurization step.

Regardless of the use of the gasoline, fuel, or source of aromatic compounds, it will therefore always be necessary to eliminate gum-generating compounds during a first selective hydrogenation step.

A problem that is often encountered in a method for selective hydrogenation in a fixed bed is the thermal control of highly exothermic reactions. Actually, the selective hydrogenation reactions are highly exothermic reactions that generally require using tempering by means of a "tempering box" (also called "quench" according to English terminology) between the catalytic beds and/or using passivated catalysts so as to prevent heat runaways that can bring about a drop in selectivity or, in the worst case, an emergency shutdown of the unit. In addition, the fact of operating in a fixed-bed reactor requires the use of catalytic substrates with relatively significant diameters (>1 mm) for limiting pressure drops within the bed, which poses problems of diffusional limitations in the grain, gradual deactivation of the catalyst, and gumming-up of the catalyst that require regular regenerations of the catalytic bed and a second reactor when the first reactor is to be reactivated or regenerated in order to operate continuously during these regenerations.

This invention relates in particular to the first step, the selective hydrogenation step (HD1), and proposes to eliminate some of its disadvantages by carrying out the method for selective hydrogenation of a liquid feedstock that comprises a pyrolysis gasoline that is not in a fixed-bed reactor but in a three-phase reactor, often also called a "slurry" reactor according to English terminology.

More particularly, the invention has as its object a method for selective hydrogenation of a liquid feedstock comprising a pyrolysis gasoline in the presence of a gaseous phase comprising hydrogen, characterized in that the operation is performed in a three-phase reactor in the presence of a selective hydrogenation catalyst that is dispersed in the liquid phase, with said method being performed at a molar ratio of (hydrogen)/(polyunsaturated compounds to be hydrogenated) of between 0.5 and 10, at a temperature of between 0° C. and 200° C., at an hourly volumetric flow rate (V.V.H.)—that is defined as the ratio of the volumetric flow rate of the feedstock at 15° C. to the total volume of the reaction zone—of between 0.5 $h^{-1}$ and 100 $h^{-1}$, and at a pressure of between 1 MPa and 6.5 MPa.

According to a variant, the size of the selective hydrogenation catalyst is between 1 and 1,000 μm.

According to a variant, the surface liquid velocity slv of the liquid phase is between 1 mm/s and 10 m/s.

According to a variant, the concentration of catalyst in the three-phase reactor in relation to the feedstock is between 5% and 40% by weight.

According to a variant, the method is carried out at a molar ratio of (hydrogen)/(polyunsaturated compounds to be hydrogenated) of between 1 and 2, at a temperature of between 80° C. and 180° C., at an hourly volumetric flow rate (V.V.H.) of between 1 $h^{-1}$ and 6 $h^{-1}$, and at a pressure of between 2 MPa and 6 MPa.

According to a variant, the selective hydrogenation catalyst comprises a metal from group VIII on a porous substrate that is formed by at least one oxide.

According to a first variant, the method comprises the following steps:

a) said liquid feedstock and a gaseous phase comprising hydrogen are continuously introduced into a three-phase reactor that contains a selective hydrogenation catalyst that is dispersed into the liquid phase, b) a gaseous phase comprising hydrogen is drawn off at the top of the reactor, c) a suspension is drawn off from the reactor, and it is introduced into a separation zone in such a way as to separate a phase containing the pyrolysis gasoline that is at least partially selectively hydrogenated and a catalyst-concentrated phase.

According to this variant, the separation of the suspension of step c) comprises a decanting.

According to a second variant, the method comprises the following steps:

a) said liquid feedstock and a gaseous phase comprising hydrogen are introduced continuously into a three-phase reactor containing a selective hydrogenation catalyst that is dispersed into the liquid phase, b) a gaseous phase comprising hydrogen is drawn off at the top of the reactor, c) a suspension is drawn off from the reactor, and it is introduced into a separation zone in such a way as to separate a C8− phase that is at least partially selectively hydrogenated and a catalyst-concentrated phase.

According to this variant, the separation of the suspension of step c) comprises an evaporation.

According to a variant, at least one part of the catalyst-concentrated phase is recycled in the three-phase reactor.

According to a variant, the pyrolysis gasoline that is at least partially selectively hydrogenated or the C8− phase that is at least partially selectively hydrogenated is/are subjected to a hydrodesulfurization that is carried out in the gaseous phase in a fixed-bed reactor in the presence of a gaseous phase comprising hydrogen and a hydrodesulfurization catalyst.

In relation to a method for selective hydrogenation operating in a fixed bed, the method according to the invention makes it possible in particular to provide better thermal control of highly exothermic reactions via a quasi-isothermal operation. Actually, the continuous liquid medium is homogenized by gas and liquid streams that enter and exit as well as the convection and diffusion phenomena. The evacuation of the heat generated by the reactions is to a very great extent promoted by heat conduction of the liquid phase with the bundle of heat-transfer tubes inside the reactor in which a heat-transfer stream evaporates. These two combined phenomena make it possible to obtain quasi-isothermal profiles and to reach higher mean operating temperatures than a conventional method in an adiabatic fixed bed, while eliminating the use of tempering boxes to prevent the phenomena of heat runaways. In contrast to the fixed bed, there is no accumulation of heat in the reactor, which is therefore close to a perfectly stirred reactor.

Likewise, owing to the higher mean operating temperatures, the catalyst is more active, promoting the kinetics of the reaction. This makes it possible to obtain a better deolefination for the same catalyst mass, which ultimately makes it possible to reduce the consumption of catalyst and to increase the duration of the cycle times. This increase in deolefination during the step for selective hydrogenation (HD1) also makes it possible to reduce the investment in the second hydrodesulfurization step (HD2) and improves the protection of fragile hydrodesulfurization catalysts in the presence of unsaturated olefins.

In addition, the fact of carrying out selective hydrogenation in a three-phase reactor in which the replacement of catalyst can be easily carried out continuously does not require a second reactor in parallel for the regeneration and/or the unloading of the spent catalyst.

In addition, the selective hydrogenation method according to the invention makes it possible to impart flexibility during operation, both as regards fractions that are more difficult to treat and in capacity variations. A more significant concentration of catalyst can actually easily be temporarily injected in the method to compensate for a change in the feedstock.

The use of three-phase reactors for carrying out highly exothermic reactions is known, for example, in the field of the Fischer-Tropsch method, in which a synthesis gas (essentially CO and hydrogen) is injected into the three-phase reactor and transformed into paraffins in the presence of a catalyst.

It is also known (US2013/204055 and CN103044179) to carry out methods for selective hydrogenation in a three-phase reactor for a C2 acetylenic gaseous feedstock in the presence of a solvent.

DETAILED DESCRIPTION

The invention has as its object a method for selective hydrogenation of a liquid feedstock comprising a pyrolysis gasoline in the presence of a gaseous phase comprising hydrogen, characterized in that the operation is performed in a three-phase reactor in the presence of a selective hydrogenation catalyst that is dispersed in the liquid phase, with said method being performed with a molar ratio of (hydrogen)/(polyunsaturated compounds to be hydrogenated) of between 0.5 and 10, at a temperature of between 0° C. and 200° C., at an hourly volumetric flow rate (V.V.H.)—that is defined as the ratio of the volumetric flow rate of the feedstock at 15° C. to the total volume of the reaction zone—of between 0.5 $h^{-1}$ and 100 $h^{-1}$, and at a pressure of between 1 MPa and 6.5 MPa.

The liquid feedstock that is injected into the three-phase reactor is a feedstock comprising a pyrolysis gasoline. Pyrolysis gasoline is defined as a gasoline that is obtained from various methods for pyrolysis, such as steam cracking, visbreaking, and/or coking. Preferably, the pyrolysis gasoline is a steam-cracking gasoline.

The pyrolysis gasoline corresponds to a hydrocarbon fraction whose boiling point is generally between 0° C. and 250° C., preferably between 10° C. and 220° C. The unsaturated hydrocarbons to be hydrogenated that are present in said pyrolysis gasoline are in particular diolefinic compounds (butadiene, isoprene, cyclopentadiene, . . . ), styrene compounds (styrene, alpha-methylstyrene, . . . ), and indene compounds (indene . . . ).

The steam-cracking gasoline generally comprises the C5-C12 fraction with traces of C3, C4, C13, C14, C15 (for example, between 0.1 and 3% by weight for each of these fractions). For example, a feedstock that is formed by pyrolysis gasoline generally has a composition in % by weight as follows: 5 to 15% by weight of paraffins, 50 to 65% by weight of aromatic compounds, 5 to 15% by weight of monoolefins, 15 to 25% by weight of diolefins, 2 to 8% by weight of alkenylaromatic compounds, and from 20 to 300 ppm by weight of sulfur (parts per million), and even up to 2,000 ppm of sulfur for certain difficult feedstocks, with all of the compounds forming 100%.

The gaseous phase that is introduced into the three-phase reactor is often composed of a mixture of hydrogen and at least one other gas, an inert gas for the reaction according to the purification method that is used. This other gas can, for example, be selected from the group that is formed by methane, ethane, propane, butane, nitrogen, argon, carbon monoxide (several ppm), and carbon dioxide. This other gas is preferably methane or propane and is more preferably free of carbon monoxide.

The proportion of hydrogen in the gaseous phase is in particular from 90 mol % to 100 mol %, and most often from 95 mol % to 99.99 mol %, with the make-up to 100% being one or more of the inert gases previously cited.

According to a particularly preferred variant of the invention, the gaseous phase consists of hydrogen.

The amount of hydrogen is preferably slightly in excess in relation to the stoichiometric value, making possible the selective hydrogenation of unsaturated compounds that are present in the hydrocarbon feedstock. In this embodiment, a surplus of hydrogen is generally between 1 and 50% by weight, preferably between 1 and 30% by weight.

The liquid feedstock and the gaseous phase comprising hydrogen are continuously fed into the three-phase reactor containing the dispersed catalyst, preferably on the base of the reactor. The reaction mixture in the three-phase reactor is thus a three-phase mixture of gas (phase comprising hydrogen and optionally selectively hydrogenated light products), liquid (feedstock comprising a pyrolysis gasoline and selectively hydrogenated products), and solid (hydrogenation catalyst and optionally gums). The reaction mixture comes in the form of a continuous phase, constituted by a liquid/solid suspension through which gas bubbles pass.

Within the three-phase reactor, the reaction mixture is kept in stirring mode because of the injection of all or part of the gas/liquid/solid mixture on the base of the reactor. The conditions for obtaining a homogeneous suspension are known to one skilled in the art. Generally, a surface liquid velocity slv will be used that is sufficient for stirring the reaction medium and thus homogenizing the temperature within the medium and putting into homogeneous suspension the solid catalyst in the liquid phase. This velocity will depend in particular on the properties of the solid (size, mass, shape) and can be between 1 mm/s (0.001 m/s) and 10 m/s, and preferably between 1 cm/s (0.01 m/s) and 0.5 m/s.

The operating conditions within the three-phase reactor make it possible to carry out the desired reactions, in particular the selective hydrogenation of diolefinic, styrene, and indene compounds.

The selective hydrogenation method is generally carried out at a molar ratio of (hydrogen)/(polyunsaturated compounds to be hydrogenated) of between 0.5 and 10, more preferably between 0.7 and 5, and preferably between 1 and 2. The flow rate of hydrogen is adjusted so as to use a sufficient amount of it to theoretically hydrogenate all of the polyunsaturated compounds and to keep a surplus of hydrogen at the reactor outlet.

The selective hydrogenation method according to the invention is generally implemented at a temperature ranging from 0° C. to 200° C., preferably ranging from 40 to 200° C., and preferably ranging from 80 to 180° C.

The pressure is preferably between 1 and 6.5 MPa, more preferably between 1.5 and 6.5 MPa, and even more preferably between 2 and 6 MPa.

The overall hourly volumetric flow rate (VVH), defined as the ratio of the volumetric flow rate of the fresh feedstock at 15° C. to the total volume of the reaction zone, is generally from 0.5 $h^{-1}$ to 100 $h^{-1}$, preferably from 0.8 $h^{-1}$ to 50 $h^{-1}$, and even more preferably between 1 and 6 $h^{-1}$. Reaction zone is defined as the zone containing the liquid/solid suspension. Its volume is generally less than the volume of the three-phase reactor because of the presence of a gaseous phase at the top of the reactor and internals in the reactor (in particular the bundle of heat-transfer tubes).

In a preferred manner, the selective hydrogenation method is carried out at a molar ratio of (hydrogen)/(polyunsaturated compounds to be hydrogenated) that is generally between 1 and 2, at a temperature that is generally between 40° C. and 200° C., preferably between 80 and 180° C., at an hourly volumetric flow rate (V.V.H.) that is generally between 1 $h^{-1}$ and 6 $h^{-1}$, and at a pressure that is generally between 2 MPa and 6 MPa.

The catalyst that is used in the method according to the invention is a catalyst that is suitable for use in a three-phase reactor: the catalyst is finely divided and is in the form of particles that can be dispersed in the liquid phase.

In terms of its chemical composition, the catalyst that is used in the method according to the invention is a catalyst that is known to one skilled in the art for a method for selective hydrogenation of a feedstock comprising a pyrolysis gasoline. It can preferably comprise at least one metal from group VIII (classification CAS (CRC Handbook of Chemistry and Physics, Editor CRC Press, Editor-in-Chief D. R. Lide, 81$^{st}$ Edition, 2000-2001) corresponding to the metals of columns 8, 9 and 10 according to the new IUPAC classification), more preferably palladium, platinum, or nickel. It is also possible to use a catalyst based on Raney nickel.

The metal from group VIII can be dispersed in a homogeneous way within the substrate. When the metal from group VIII is palladium or platinum, the palladium or platinum content is between 0.01 and 2% by weight of the mass of the catalyst, preferably 0.03 and 0.8% by weight.

When the metal from group VIII is nickel, the nickel content is between 1 and 65% by weight of the mass of the catalyst, preferably between 5 and 50% by weight, and more preferably between 7 and 40% by weight.

The "% by weight" values are based on the elementary form of the metal from group VIII.

The catalyst comprises in particular a porous substrate that is formed by at least one simple oxide selected from among alumina ($Al_2O_3$), silica ($SiO_2$), titanium oxide ($TiO_2$), cerium oxide ($CeO_2$), and zirconia ($ZrO_2$). In a preferred manner, said substrate is selected from among aluminas, silicas, and silica-aluminas.

The porous substrate in particular can come in the form of balls or a powder that may or may not be obtained from a crushing or grinding method.

Typically, for use in a three-phase reactor, the catalyst is finely divided and is in the form of particles. Generally, the size of the catalyst that is used in the selective hydrogenation method according to the invention can be between 1 and 1,000 micrometers (1 mm); preferably, it is between 80 and 500 micrometers (μm), and in a preferred manner between 100 and 400 micrometers (μm).

Preferably, the used catalyst can also comprise at least one doping agent that belongs to column IB of the periodic table, which can preferably be selected from the group that is formed by gold, silver, and copper, and more preferably sulfur. It can also comprise tin.

Preferably, the selective hydrogenation catalyst also comprises at least one metal that is selected from the group that consists of alkalines and alkaline-earths.

The catalyst can also comprise silicon or boron.

The catalyst concentration in the three-phase reactor in relation to the feedstock is generally between 5% and 40% by weight, preferably between 10% and 30% by weight.

Prior to use in a selective hydrogenation method, the selective hydrogenation catalysts generally undergo at least one reducing treatment, optionally followed by passivation, generally with sulfur.

The selective hydrogenation method according to the invention is applied both for the production of fuel with a high octane number (first variant) and for the production of fractions that are rich in aromatic hydrocarbons (second variant).

First Variant

According to a first variant, in particular when it is desired to produce fuels, the method according to the invention comprises the following steps:

a) said liquid feedstock and a gaseous phase comprising hydrogen are continuously introduced into a three-phase reactor containing a selective hydrogenation catalyst that is dispersed in the liquid phase, b) a gaseous phase comprising hydrogen and optionally light products from the ($C_{5-}$) fraction selective hydrogenation reaction are drawn off at the top of the reactor, c) a suspension comprising pyrolysis gasoline that is at least partially selectively hydrogenated in liquid form and the catalyst in solid form are drawn off from the reactor, and the suspension is introduced into a separation zone in such a manner as to separate a phase containing pyrolysis gasoline that is at least partially selectively hydrogenated and a catalyst-concentrated phase.

In addition, the suspension can also comprise the unconverted feedstock as well as dissolved gaseous components.

The liquid phase containing the pyrolysis gasoline that is at least partially selectively hydrogenated can then be sent into the hydrodesulfurization step (HD2) for which it is to be heated so as to be fed in gaseous form.

According to this first variant, the gaseous phase comprising unreacted hydrogen and optionally light products from the selective hydrogenation reaction ($C_{5-}$ fraction) that is drawn off from the three-phase reactor is advantageously cooled, bringing about the condensation of a part of the heaviest compounds. This cooled stream is advantageously separated in a separation means, for example a separator tank, making it possible to separate a gaseous phase comprising unreacted hydrogen and non-condensable gaseous products from the selective hydrogenation reaction of a liquid phase containing the condensed products from the reaction. At least one part of the gaseous phase comprising unreacted hydrogen can advantageously be used in the following hydrodesulfurization (HD2) and/or be recycled in the three-phase reactor (HD1). The liquid phase containing the condensed products from the reaction is advantageously sent into the hydrodesulfurization step (HD2).

The suspension is advantageously introduced into a separation zone in such a way as to separate a liquid phase containing the pyrolysis gasoline that is at least partially selectively hydrogenated and a catalyst-concentrated phase, and optionally a gaseous phase comprising unreacted hydrogen and light products from the reaction.

The separation zone can comprise in particular gas/liquid or gas/liquid and solid separation means, for example a gas separator tank, as well as liquid/solid separation means, for example a decanter, a hydrocyclone, or a filter.

Advantageously, the suspension that is drawn off from the reactor is subjected to a degassing (for example, in a gas separator tank) and then introduced into a decanter that makes it possible to separate a liquid phase containing pyrolysis gasoline that is at least partially selectively hydrogenated from a catalyst-concentrated phase. The liquid phase containing the pyrolysis gasoline that is at least partially selectively hydrogenated in the decanter is then advantageously subjected to filtration, and then sent into the hydrodesulfurization step after vaporization.

The catalyst-concentrated phase is evacuated from the bottom of the decanter and can be at least in part recycled in the three-phase reactor. The catalyst-concentrated phase can be injected in a mixture with the liquid feedstock and/or the gaseous phase containing hydrogen or separately.

Before this recycling, all or part of the catalyst-concentrated phase can be subjected to a regeneration and/or rejuvenation of the catalyst.

The regeneration of the catalyst can be carried out in particular at a temperature ranging from 200 to 480° C., with a gradual rise by temperature, under nitrogen, and with successive additions of water vapor (steam stripping according to English terminology) and oxygen (combustion). The catalyst is then reactivated under hydrogen, and optionally with the addition of sulfur-containing molecules, in order to resume its initial state.

The rejuvenation of the catalyst (hot hydrogen stripping according to English terminology) can be carried out in particular at a temperature ranging from 200 to 450° C., with a gradual rise by temperature, under nitrogen and hydrogen.

The regenerated and/or rejuvenated catalyst can then be reintroduced into the three-phase reactor.

FIG. 1 illustrates the method according to the invention according to this first variant.

The liquid feedstock comprising a pyrolysis gasoline (1) is mixed with a gaseous phase comprising hydrogen (3). The mixture is then introduced via the line (5) into the three-phase reactor (7) in which a selective hydrogenation catalyst is found in the form of finely divided particles. The liquid feedstock and the gaseous phase comprising hydrogen can also be injected separately into the reactor, without a preliminary mixing.

Advantageously, the three-phase reactor (7) comprises a heat exchanger (9), for example a tube bundle, so as to cool—by injection via the line (13) of a coolant (11), for example water—the reaction medium during selective hydrogenation reactions that are exothermic. The coolant passes through the heat exchanger, is heated and evaporated partially, and is evacuated via the line (15) into a gas/liquid separator tank (17), in which the coolant is recovered in gaseous form, for example water vapor, via the line (19), and the coolant in liquid form via line (21), which is advantageously recycled in the line (13) to be reinjected into the heat exchanger (9); the pressure regulated within the separator tank (17) makes it possible to set the temperature in the reactor.

At the top of the reactor (7), a line (23) makes it possible to evacuate a gaseous phase comprising unreacted hydrogen and optionally light products from the selective hydrogenation reaction ($C_{5-}$ fraction). This gaseous phase advantageously passes through a cooling exchanger (25), with said cooling bringing about the condensation of a part of the heaviest compounds, which are separated in a separator tank (27). This tank makes it possible to separate a gaseous phase comprising unreacted hydrogen and non-condensable products, evacuated via the line (29), from a liquid phase comprising light condensed products from the reaction, evacuated via line (31) supplying the tank (49).

The suspension is evacuated from the reactor (7) via the line (33) and is introduced into a separation zone Z (dotted-line frame in FIG. 1) comprising, for example, a gas separator tank (35), a decanter (41), and a filter (45). Advantageously, as illustrated in FIG. 1, the suspension is introduced via the line (33) into a separator tank (35) making it possible to carry out degassing and to separate a gaseous phase comprising unreacted hydrogen and light products from the reaction ($C_{5-}$), evacuated via the line (37), from the suspension that is evacuated via the line (39). The gas evacuated via the line (37) is advantageously directed toward the line (23) for drawing off the gaseous phase from the reactor (7), upstream from the exchanger (25), so as to join the circuit for separating incondensable products (29) and light products from the reaction (31). The suspension evacuated from the separator tank (35) via the line (39) is directed toward a decanter (41) in which the following are obtained by decanting: in its lower outlet (53), a catalyst-concentrated phase containing in addition products from the reaction, and in its upper outlet (43), a phase containing pyrolysis gasoline that is at least partially selectively hydrogenated, and a small amount of non-decanted solids.

The catalyst-concentrated phase is evacuated from the bottom of the decanter via the line (53). This last phase is pumped by equipment means (55), such as, for example, a pump, and then is next reintroduced into the reactor via the line (57). The catalyst-concentrated phase can be injected in a mixture with the liquid feedstock and/or the gaseous phase containing hydrogen (as illustrated in FIG. 1) or separately.

Advantageously, all or part of the catalyst-concentrated phase can be drawn off via the line (59) so as to remove the (spent) catalyst and/or to initiate a regeneration and/or rejuvenation of the catalyst.

The regenerated and/or rejuvenated catalyst can then be reintroduced via the line (61). If necessary, fresh catalyst can also be introduced via the line (61).

The liquid phase containing pyrolysis gasoline that is at least partially selectively hydrogenated is evacuated from the upper part of the decanter via the line (43), optionally passes through a filter (45) so as to eliminate the possible remaining catalyst particles (and gums), and then is recovered via the line (47) in the collecting tank (49) that is also advantageously supplied by the liquid phase obtained from the separator (27). The pyrolysis gasoline that is thus at least partially selectively hydrogenated can then be directed via the line (51) to the hydrodesulfurization step (not shown).

Second Variant

According to a second variant, in particular when it is desired to produce a fraction that is rich in aromatic compounds, the method according to the invention comprises the following steps:

a) said liquid feedstock and a gaseous phase comprising hydrogen are continuously introduced into a three-phase reactor containing a selective hydrogenation catalyst that is dispersed in the liquid phase,
b) a gaseous phase comprising hydrogen and optionally light products from the ($C_5$_ fraction) selective hydrogenation reaction are drawn off at the top of the reactor,
c) a suspension comprising the pyrolysis gasoline that is at least partially selectively hydrogenated in liquid form and the catalyst in solid form are drawn off from the reactor, and the suspension is introduced into a separation zone in such a way as to separate a C8− gaseous phase that is at least partially selectively hydrogenated and a catalyst-concentrated liquid phase.

The C8− gaseous phase that is at least partially selectively hydrogenated is then sent directly into the hydrodesulfurization step without intermediate condensation. This scheme offers the advantage that the C8− exiting in gaseous form from the separator can be used directly in the hydrodesulfurization step (HD2) without the need for an intermediate distillation (tailing of C9+), which is intensive in energy and equipment costs, and that the flow rate of the liquid phase exiting from the separator is reduced in relation to the first variant, making possible a reduction in size of the equipment for separation and recycling of this phase.

According to this second variant, the gaseous phase comprising unreacted hydrogen that is drawn off from the three-phase reactor is advantageously heated and introduced into the hydrodesulfurization reactor, optionally in a mixture with the C8− gaseous phase obtained from the suspension.

The suspension that is drawn off is advantageously introduced into a separation zone whose temperature is set in such a way as to vaporize the C8− phase that is at least partially selectively hydrogenated, in such a way as to separate a gaseous phase containing the C8− fraction that is at least partially selectively hydrogenated, optionally the light products from the reaction, as well as the unreacted hydrogen, from a catalyst-concentrated liquid phase. The catalyst-concentrated liquid phase comprises heavier (C9+) compounds that are obtained from the feedstock and/or from the reaction.

The separation zone can comprise in particular gas/liquid or gas/liquid and solid separation means, for example an evaporator tank, as well as liquid/solid separation means, for example, a decanter, a hydrocyclone, or a filter.

According to a first mode, at least one part of the catalyst-concentrated liquid phase is directly recycled in the three-phase reactor.

According to a second mode, at least one part of the catalyst-concentrated liquid phase is subjected to additional separations, such as a decanter in which there is obtained by decanting: in its lower outlet, a catalyst-concentrated liquid phase, and in its upper outlet, a clarified liquid phase containing in particular the C9+ compounds and a small amount of non-decanted solids. The catalyst-concentrated liquid phase is recycled in the three-phase reactor.

Before this recycling, all or part of the catalyst-concentrated phase can be subjected to a regeneration and/or rejuvenation of the catalyst under the conditions that are described above.

The clarified liquid phase containing in particular the C9+ compounds is evacuated, optionally after a filtration, thus making it possible to reduce the flow rate of the feedstock from the hydrodesulfurization step.

The C8− gaseous phase that is at least partially selectively hydrogenated is advantageously heated and introduced into the hydrodesulfurization reactor, preferably in the presence of the gaseous phase comprising hydrogen obtained from the three-phase reactor.

The hydrodesulfurization (HD2) is carried out under operating conditions that are known to one skilled in the art. The procedure is generally performed with a molar ratio of (hydrogen)/(polyunsaturated compounds to be hydrogenated) of between 0.5 and 10, more preferably between 0.7 and 5, and preferably between 1 and 2. The hydrodesulfurization is generally implemented at a temperature ranging from 0° C. to 500° C., preferably ranging from 100 to 450° C., and preferably ranging from 200 to 400° C.

The pressure is preferably between 2 and 8 MPa, more preferably between 2.5 and 7.5 MPa, and even more preferably between 3 and 7 MPa.

The overall hourly volumetric flow rate (VVH), defined as the ratio of the volumetric flow rate of the fresh feedstock at 15° C. to the total volume of the catalyst, is generally from 0.1 $h^{-1}$ to 80 $h^{-1}$, preferably from 0.4 $h^{-1}$ to 40 $h^{-1}$, and even more preferably between 0.5 and 5 $h^{-1}$.

The catalyst that is used in the hydrodesulfurization is a catalyst that is known to one skilled in the art. The catalyst is generally a substrate catalyst having an active phase comprising a metal from group VIB and/or group VIII, of the NiMo or CoMo type, or else of the NiW or CoW type. The catalyst is generally used in sulfide form. The catalyst comprises in particular a porous substrate that is formed by at least one simple oxide that is selected from among alumina ($Al_2O_3$), silica ($SiO_2$), titanium oxide ($TiO_2$), cerium oxide ($CeO_2$), and zirconia ($ZrO_2$). In a preferred manner, said substrate is selected from among aluminas, silicas, and silica-aluminas.

The porous substrate can come in particular in the form of balls, extrudates (for example in trilobed or quadrilobed form), pellets, or agglomerates that are irregular and non-spherical, whose specific shape can result from a crushing step. In a very advantageous manner, the substrate comes in the form of balls or extrudates.

Typically, for an implementation in a fixed-bed reactor, the size of the catalyst that is used in hydrodesulfurization is on the order of several millimeters, generally greater than 1 mm, generally between 1.5 and 4 mm.

The effluent exiting from the hydrodesulfurization reactor is hot and makes it possible to heat—by a heat exchanger—the C8− phase that is at least partially selectively hydrogenated (C8−) obtained from the evaporator.

The thus cooled effluent is then advantageously subjected to a separation making it possible to separate a gaseous phase comprising unreacted hydrogen and light products from the reaction from a liquid phase comprising in particular the desired aromatic compounds. A part of the liquid phase comprising aromatic compounds can be used as liquid quenching in the hydrodesulfurization reactor.

The gaseous phase comprising unreacted hydrogen is advantageously purified and recycled in the hydrodesulfurization reactor (HD2). According to another variant, the phase comprising the purified hydrogen can also be recycled in the three-phase reactor (HD1).

FIG. 2 illustrates the method according to the invention according to this second variant.

The liquid feedstock comprising a pyrolysis gasoline (1) is mixed with a gaseous phase comprising hydrogen (3). The mixture is then introduced via the line (5) in the three-phase reactor (7) in which a selective hydrogenation catalyst is found in the form of finely divided particles. The liquid feedstock and the gaseous phase comprising hydrogen can also be injected separately into the reactor without preliminary mixing.

Advantageously, the three-phase reactor (7) comprises a heat exchanger (9) that operates in the same manner as that described for FIG. 1.

At the top of the reactor (7), a line (63) makes it possible to evacuate a gaseous phase comprising unreacted hydrogen and optionally light products from the selective hydrogenation reaction ($C_{5-}$ fraction).

A line (33) makes it possible to evacuate the suspension from the reactor that is introduced into a separation zone Z (dotted-line frame in FIG. 2) comprising, for example, an evaporator (65), a decanter (41), and a filter (45). Advantageously, as illustrated in FIG. 2, the suspension is introduced via the line (33) into an evaporator (65) that is heated by a heating means (67), for example a coolant such as pressurized water, oil, or any other compound that is stable at the temperature that is required in the evaporator. The evaporator (65) makes it possible to vaporize the C8− phase, which is at least partially selectively hydrogenated and is advantageously sized in the form of a tank that makes it possible to carry out a separation of the C8− gaseous phase that is at least partially selectively hydrogenated, and optionally unreacted hydrogen and light products from the reaction, evacuated via the line (23), from a catalyst-concentrated liquid phase containing in addition heavier compounds (C9+) that is evacuated via the line (69). The equipment (65) making it possible to carry out the separation of the stream (33) can, according to another variant, consist of two separate items: an evaporator and a gas/liquid separator.

According to a first variant, at least one part of the catalyst-concentrated phase that is evacuated from the evaporator (65) via the line (69) is reintroduced directly via the lines (53) and (57) into the reactor by an equipment means (55), such as, for example, a pump. The catalyst-concentrated phase can be injected into a mixture with the liquid feedstock and/or the gaseous phase containing hydrogen (as illustrated) in FIG. 2 or separately.

According to a second variant, at least one part of the catalyst-concentrated phase that is evacuated from the evaporator (65) via the line (47) is directed to a decanter (41) in which the following are obtained by decanting: in its lower outlet (53), a catalyst-concentrated liquid phase, and in its upper outlet (43), a clarified liquid phase containing in particular the C9+ compounds and a small amount of non-decanted solids. The catalyst-concentrated liquid phase is evacuated from the bottom of the decanter via the line (53) and is optionally mixed with the catalyst-concentrated phase coming in via the line (69). This last phase is pumped by means of the equipment (55), such as, for example, a pump, and then is next reintroduced into the reactor via the line (57).

Advantageously, all or part of the catalyst-concentrated phase can be drawn off via the line (59) so as to remove the catalyst (spent) and/or to initiate a regeneration and/or rejuvenation of the catalyst.

The regenerated and/or rejuvenated catalyst can then be reintroduced via the line (61). If necessary, fresh catalyst can also be introduced via the line (61).

The clarified liquid phase containing in particular the C9+ compounds and a small amount of non-decanted solids is evacuated from the upper part of the decanter via the line (43), optionally passes through a filter (45) so as to eliminate the possible remaining catalyst particles (and the gums), and then is evacuated via the line (47).

The C8− gaseous phase that is at least partially selectively hydrogenated and evacuated via the line (23) is mixed with the gaseous phase comprising unreacted hydrogen and optionally light products from the selective hydrogenation reaction ($C_{5-}$ fraction), then advantageously passes through a heat exchanger (71) and then a furnace (73) so as to heat it.

This C8− gaseous phase is then introduced via the line (75) into the hydrodesulfurization reactor (77) in a fixed bed in which the hydrogenation of the sulfide compounds but also the almost complete hydrogenation of the remaining olefins are carried out. The effluent from the hydrodesulfurization reactor exiting via the line (79) is directed toward the heat exchanger (71) so as to cool the effluent while preheating the C8− gaseous phase.

The thus cooled effluent from the hydrodesulfurization reactor is then directed toward a condenser (81) bringing about the condensation of a part of the heaviest compounds, which are separated in a separator tank (83). This tank makes it possible to separate a gaseous phase comprising unreacted hydrogen and the non-condensable products from the reaction, evacuated via the line (85), from a liquid phase comprising the desired product, in particular a fraction that is rich in desired aromatic compounds, evacuated via the line (87). A part of the liquid phase comprising aromatic compounds can be used as liquid quenching in the hydrodesulfurization reactor, advantageously injected between two fixed beds via the line (89).

The gaseous phase comprising unreacted hydrogen of the line (85) is advantageously subjected to a purification (91), for example an amine washing, so as to remove the $H_2S$ that is formed and other impurities that are produced during the hydrodesulfurization. The gaseous phase comprising purified hydrogen is advantageously recycled via the line (93), compressed in the compressor (95) and introduced via the line (63) into the hydrodesulfurization reactor. According to another variant, the phase comprising purified hydrogen can also be recycled in the three-phase reactor (not shown).

EXAMPLES

Example 1 According to the Prior Art

This example according to the prior art illustrates a method for selective hydrogenation that is carried out in a fixed bed using two reactors in parallel and in which a single reactor is used while the other reactor is reactivated or regenerated.

A pyrolysis gasoline feedstock "PyGas" having a MAV value of 210 (MAV for Maleic Anhydride Value according to English terminology, diolefin content measurement) and a bromine number of 81 (olefin content measurement), containing 2.5% styrene (and 6% C9+ styrene compounds), was treated by a hydrogenation method according to the prior art, under the following operating conditions:

- Feedstock flow rate: 175 t/h
- Composition of the gaseous phase comprising hydrogen: 95% $H_2$, 5% $CH_4$
- Total hydrogen flow rate: 3.5 t/h ($H_2$+$CH_4$)
- VVH, defined as the ratio of the volumetric flow rate of fresh feedstock at 15° C. to the catalytic bed volume: 1.5 $h^{-1}$
- Volume of catalyst of 97 tons in a reactor with a diameter of 3,300 mm (1° main reactor, active catalyst)
- Catalyst reserve of 97 tons in a reactor with a diameter of 3,300 mm (2° main reactor, inactive catalyst)
- Recycling flow rate: 300 t/h
- Quenching flow rate: 300 t/h
- Absolute pressure at reactor entry: 3 MPa (30 bar)
- Temperature at reactor entry: 60° C.
- Mean temperature in the reactor: 100° C.

The objective in this example is to reduce the styrene content (and in particular most of the diolefins, which are easier to hydrogenate) to 0.5% by weight at the outlet of the reactor. At the outlet, a MAV of 1 and an IBr of 40 are obtained.

In this embodiment, a single reactor is used for the hydrogenation. 100% of the desired conversion into styrene is therefore to be carried out in this reactor.

The method according to this example therefore requires a mass of 194 tons of fresh catalyst, distributed onto two 97-ton reactors, to treat the feedstock to the desired specifications. With the estimated service life of the catalyst being 6 months, the 194 tons of catalysts distributed onto two reactors makes possible a treatment of the feedstock for one year.

Example 2 According to the Invention

The same olefinic feedstock as the one treated in Example 1 (for comparison) was treated by a hydrogenation method according to the invention, comprising a so-called "slurry" three-phase reactor with a recycling loop on which a liquid/solid separation means is operated, said means making it possible to recover the effluent that is partially selectively hydrogenated. A catalyst mass that is smaller by 90% (9 t instead of 97 t) than the one used in the reactors of Example 1 is present in the three-phase reactor, put into motion by the streams of fresh and partially hydrogenated pyrolysis gasoline and gas that consists partially of hydrogen, at gas and liquid surface speeds of, respectively, 10 and 5 cm/s. Fresh and/or rejuvenated and/or regenerated catalyst is introduced in an amount of 9 t/year. The operating conditions are as follows:

- Feedstock flow rate: 175 t/h
- Composition of the gaseous phase comprising hydrogen: 95% $H_2$, 5% $CH_4$
- Total hydrogen flow rate: 5 t/h ($H_2$+$CH_4$)
- VVH, defined as the ratio of the volumetric flow rate of fresh feedstock at 15° C. to the reaction zone volume: 4 $h^{-1}$
- Catalyst mass of 9 tons in a reactor with a diameter of 2,000 mm (1° main reactor, active catalyst)
- Catalyst reserve of 9 tons for the make-up/regeneration of catalyst over a period of 12 months
- Recycling flow rate: 140 t/h
- Absolute pressure at reactor entry: 3 MPa (30 bar)
- Temperature at reactor entry: 60° C.
- Mean temperature in the reactor: 140° C.

The objective in this example is to maintain a performance that is equivalent to that of Example 1) in terms of hydrogenation of diolefins (MAV), and in particular of styrene, whose content should be less than 0.5% by weight at the outlet. Iso-performance—owing to this technology—makes possible better use of the catalyst because all of the active sites are used for the reaction, and the better thermal control makes it possible to operate at higher temperatures (140 versus 100° C. on average) without fear of heat runaway.

In addition, while obtaining the same output MAV as Example 1), a smaller IBr is obtained: 30 versus 40 in Example 1), which corresponds to a 13% better deolefination. Thus, the following deolefination and desulfurization step (HD2) is facilitated by 25%.

Furthermore, the continuous operation that is inherent to the technology of Example 2) makes it possible to extend the service life, because the latter is not limited by the deactivation of the catalyst, contrary to Example 1).

The advantages of this method for selective hydrogenation of a feedstock comprising a pyrolysis gasoline carried out in a three-phase reactor are therefore numerous since it makes possible:

- A reduction of more than 90% of the catalytic feedstock (18 annual tons versus 194 annual tons for the conventional method);
- A large reduction in the number and size of the reactors (one three-phase reactor with a diameter of 2,000 mm versus two fixed-bed reactors with diameters of 3,300 mm);
- An isothermal reactor temperature that is controlled by the circulation of fluids and by the internal heat exchanger;
- A 13% better deolefination in Example 2 in comparison to Example 1.

Figure 1:
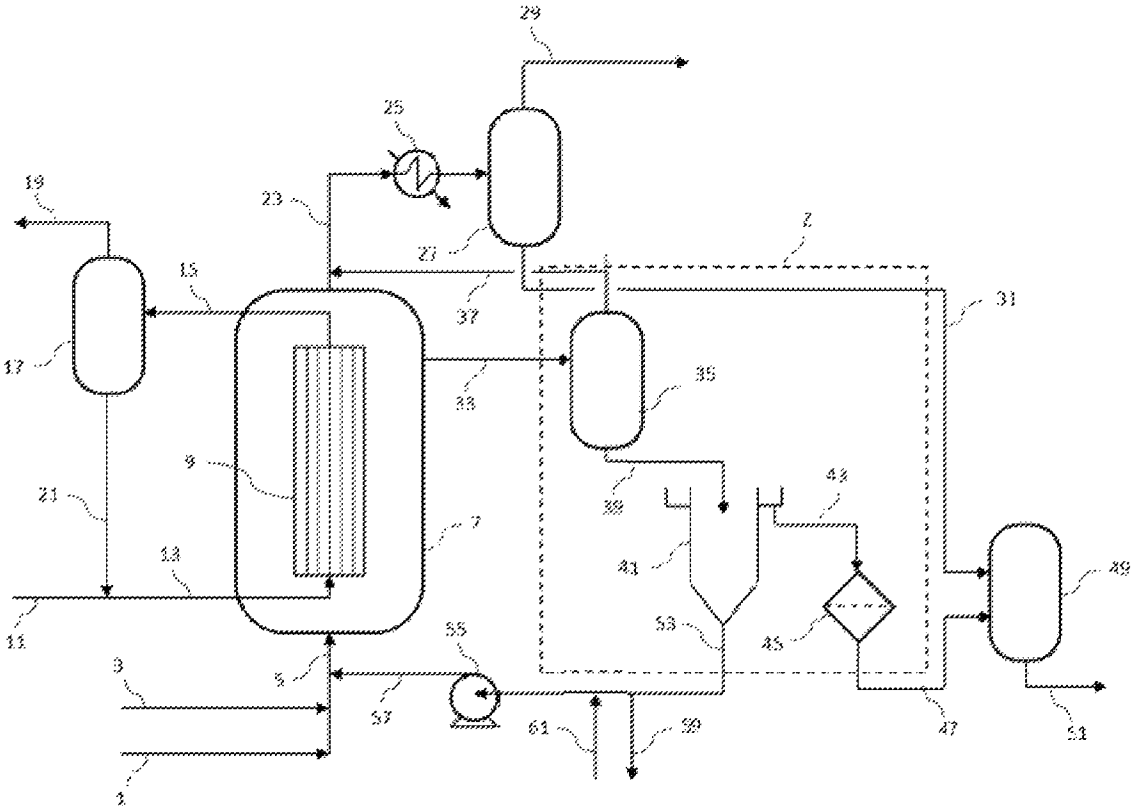
FIG. 1 illustrates the method according to the invention according to a first variant.
Figure 2:
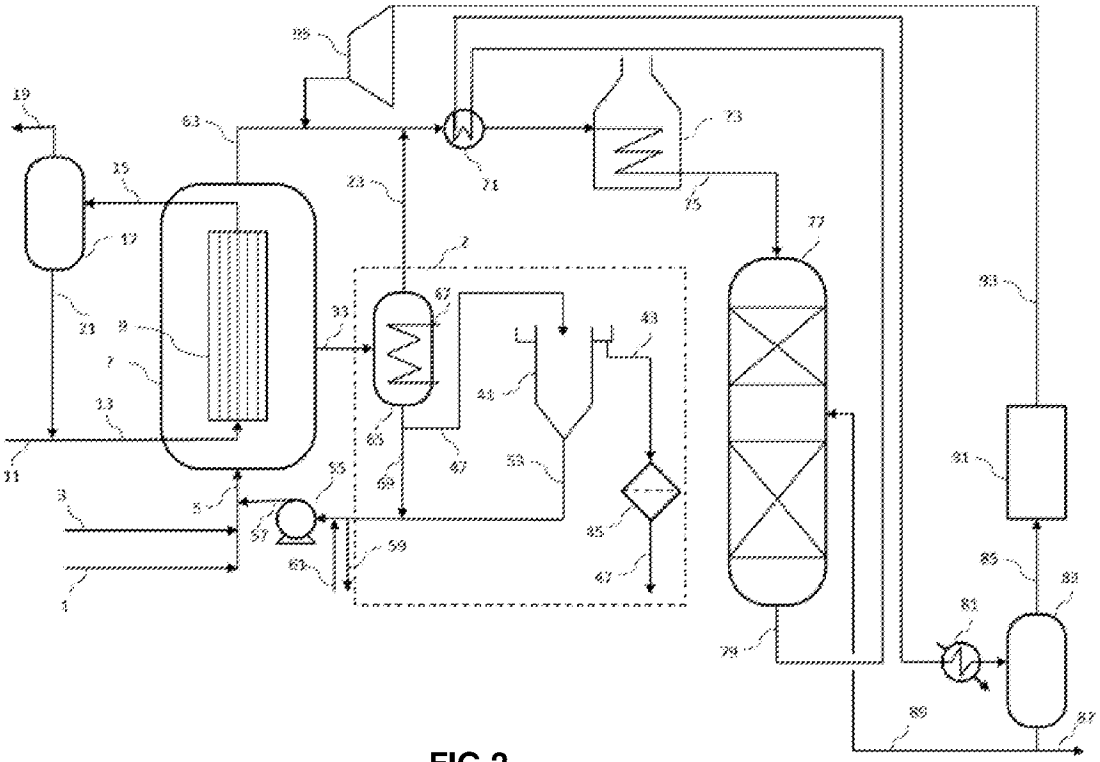
FIG. 2 illustrates the method according to the invention according to a second variant.

The invention claimed is:

1. Method for selective hydrogenation of at least polyunsaturated compounds in a liquid phase feedstock comprising a pyrolysis gasoline, which comprises polyunsaturated compounds, in the presence of a gaseous phase comprising hydrogen, wherein the hydrogenation is performed in a three-phase reactor having a reaction zone volume in the presence of a selective hydrogenation catalyst that is dispersed in the liquid phase, the hydrogenation being performed at a molar ratio of (hydrogen)/(polyunsaturated compounds to be hydrogenated) of between 0.5 and 10, at a temperature of between 0° C. and 200° C., at an hourly volumetric flow rate (V.V.H.)—that is defined as a ratio of volumetric flow rate of the feedstock at 15° C. to total volume of the reaction zone—of between 0.5 $h^{-1}$ and 100 $h^{-1}$, and at a pressure of between 1 MPa and 6.5 MPa;

said method comprising:

a) continuously introducing said liquid phase feedstock and the gaseous phase comprising hydrogen into a three-phase reactor containing a selective hydrogenation catalyst that is dispersed into the liquid phase, b) drawing a gaseous phase comprising hydrogen off at the top of the reactor, c) drawing a suspension from the reactor and introducing it into a separation zone in such a way as to separate either a phase containing the pyrolysis gasoline that is at least partially selectively hydrogenated and a catalyst-concentrated phase, or a C8− phase that is at least partially selectively hydrogenated and a catalyst-concentrated phase.

2. Method according to claim 1, in which the selective hydrogenation catalyst is between 1 and 1,000 μm in size.

3. Method according to claim 1, in which the liquid phase has a surface liquid velocity (slv) of between 1 mm/s and 10 m/s.

4. Method according to claim 1, in which the selective hydrogenation catalyst in the three-phase reactor has a concentration in relation to the feedstock of between 5% and 40% by weight.

5. Method according to claim 1, wherein the hydrogenation is carried out at a molar ratio of (hydrogen)/(polyunsaturated compounds to be hydrogenated) of between 1 and 2, at a temperature of between 80° C. and 180° C., at an hourly volumetric flow rate (V.V.H.) of between 1 $h^{-1}$ and 6 $h^{-1}$, and at a pressure of between 2 MPa and 6 MPa.

6. Method according to claim 1, in which the selective hydrogenation catalyst comprises a metal from group VIII on a porous substrate formed by at least one oxide.

7. Method according to claim 1, wherein, in the separation zone, a phase containing the pyrolysis gasoline that is at least partially selectively hydrogenated and a catalyst-concentrated phase are separated.

8. Method according to claim 7, in which the separation in the separation zone comprises a decanting.

9. Method according to claim 1, wherein, in the separation zone, a C8-phase that is at least partially selectively hydrogenated and a catalyst-concentrated phase are separated.

10. Method according to claim 9, in which the separation in the separation zone comprises an evaporation.

11. Method according to claim 7, in which at least a part of the catalyst-concentrated phase is recycled to the three-phase reactor.

12. Method according to claim 1, in which the pyrolysis gasoline that is at least partially selectively hydrogenated or the C8− phase that is at least partially selectively hydrogenated is/are subjected to a hydrodesulfurization that is carried out in a gaseous phase in a fixed-bed reactor in the presence of a gaseous phase comprising hydrogen and a hydrodesulfurization catalyst.

13. Method according to claim 1, wherein the feedstock comprising a pyrolysis gasoline comprises: 5 to 15% by weight of paraffins, 50 to 65% by weight of aromatic compounds, 5 to 15% by weight of monoolefins, 15 to 25% by weight of diolefins and 2 to 8% by weight of alkenylaromatic compounds.

14. Method according to claim 1, wherein the feedstock comprising a pyrolysis gasoline comprises a C5-C12 fraction.

* * * * *